United States Patent [19]

Kydonieus et al.

[11] 3,961,117

[45] June 1, 1976

[54] ANTISTATIC CARPET AND METHOD FOR MANUFACTURING SAME

[75] Inventors: Agis F. Kydonieus, Kendall Park; Inja Smith, Montclair, both of N.J.

[73] Assignee: Herculite Protective Fabrics Corporation, New York, N.Y.

[22] Filed: Nov. 21, 1973

[21] Appl. No.: 417,833

[52] U.S. Cl. ..... 428/96; 428/95

[51] Int. Cl.[2] ..... D03D 27/00; D04H 11/00; D05C 17/00

[58] Field of Search ..... 161/62–67; 117/139.5; 317/2; 428/95, 96, 97, 922

[56] References Cited

UNITED STATES PATENTS 3,510,386 5/1970 Goins ..... 161/67

3,728,205 4/1973 Brindell ..... 161/66

*Primary Examiner*—Marion E. McCamish

*Attorney, Agent, or Firm*—Sughrue, Rothwell, Mion, Zinn & Macpeak

[57] ABSTRACT

There are disclosed antistatic carpet products and compositions and methods for producing such carpets. Application to carpet backing of polymeric compositions containing migrating antistatic agents, and in certain instances accelerators for such agents, imparts antistatic properties to carpet fibers of natural and synthetic material.

10 Claims, No Drawings

ANTISTATIC CARPET AND METHOD FOR MANUFACTURING SAME

BACKGROUND OF THE INVENTION

1. Field of the Invention

The present invention relates to the production of antistatic carpets and compositions effective for this purpose, including active agents capable of migrating into carpet fibers. The invention also concerns the acceleration of the rate at which antistatic properties are imparted to the carpet fibers.

2. Description of the Prior Art

The uncomfortable, and sometimes painful and/or dangerous discharge of static electricity from a person's body to a grounded object which occurs after the person has walked on common carpet materials is an all too familiar and unpleasant phenomenon. Carpets manufactured from both natural fibers, such as, wool, and synthetic fibers, such as, fibers of acrylics, nylons, polyesters and lower polyolefins, such as, polyethylene and polypropylene, all exhibit this undesirable characteristic, especially under low humidity conditions.

Many attempts have been made to overcome or at least mitigate the problem. Investigation has shown that the level of human sensitivity to static discharge occurs at about 3,000 volts and above. Accordingly, a guideline in the search for solutions to the problem has been the reduction of static build-up to below the human sensitivity threshold of 3,000 volts.

We are aware that according to a process developed by Herculite Protective Fabrics Corporation, assignee of this invention, it has been discovered that a variety of active properties can be imparted to solid, non-porous polymeric substrate materials by a technique which comprises applying to the substrate a solid, non-porous layer of a polymeric composition containing active agents capable of migrating from the layer into and throughout the substrate. The migrating agent is incorporated in the layer in an amount sufficient to produce an effective level of activity on the surface of the substrate which is not in direct contact with the layer. The application of the Herculite technology, known generally in the industry as the HERCON process to the production of antistatic and electrically conductive polymeric materials is broadly described in U.S. Pat. No. 3,705,938 issued Dec. 12, 1972 and in pending application Ser. No. 255,144 which is a divisional application related to the just mentioned issued patent.

We are also aware that U.S. Pat. No. 3,510,386 Goins et al. discloses an antistatic carpet structure in which antistatic agents are added to a layer applied to the primary carpet backing. According to the disclosure of this patent an antistatic composition consisting essentially of a mixture of an organic textile antistatic agent and a humectant is applied to a porous carpet backing so that the antistatic coating composition penetrates the backing of the carpet and wets the base of the pile fabric, but does not penetrate to the outer tips of the pile. Charges of static electricity built up in the pile are said to be dispersed throughout the entire carpet area by the antistatic layer and subsequently bled off into the ground or atmosphere.

Some other attempts to overcome the static problem in carpets have included the weaving of conductive filaments into the carpet, spraying conductive agents on to the carpet fibers and loading the carpet backing material with antistatic agents, such as, carbon black or other conductive fillers. All such attempts have suffered from one or more basic defects, including damage to the carpet structure or appearance, lack of durability of the antistatic effect, or greatly increased cost.

Accordingly, it is an objective of the present invention to provide a new approach to rendering carpets antistatic in accordance with which durable antistatic properties are imparted to the carpet fibers themselves.

It is a further object of the present invention to provide a method for rendering carpets antistatic so that the antistatic effect is accomplished, economically, rapidly and without damage to the appearance or structure of the carpet.

Another object of the invention is to provide carpets with durable antistatic properties.

SUMMARY OF THE INVENTION

In accordance with the present invention carpets of wool, nylon, acrylic, polyester, and lower polyolefin fibers are rendered antistatic by the application to the primary carpet backing, or a layer in contact with the primary carpet backing, of a solid layer of solid, non-porous, polymer composition containing at least one antistatic agent capable of migrating into and throughout the carpet fibers to render the fibers electrically conductive and antistatic. In certain instances, especially in the treatment of nylon and polyester carpets, a carrier or accelerator for the antistatic agent is incorporated in the composition in order to achieve the desired level of antistatic activity more rapidly.

As a result of our research it has been found that certain carpet fibers, notably nylon and polyester, do not reach a level of antistatic properties upon treatment in accordance with this invention at the same rate as certain other fibers, such as, acrylic fibers, which react rather rapidly to the application of migrating antistatic agents, and therefore, do not require acceleration of the effect. Nylon and polyester carpet fibers, such as those incorporated in the commercial carpet fiber products of duPont, Bigelow, Lees and other fiber manufacturers, however, do not respond too rapidly to treatment in accordance with the previously described HERCON technology, and the requirement for extended periods of aging to allow the effects to be fully realized can seriously interfere with the manufacture, storage, distribution and sales of carpet products on a commercial basis. In accordance with the present invention, however, satisfactory reduction in resistivity of carpets treated with the antistatic compositions of this invention is fully effective in about 1 to 2 weeks and certainly in less than 3 weeks, even with carpets made from nylon and polyester fibers. This allows the carpets to reach the required level of antistatic properties before they reach the point of installation.

The antistatic compositions may be applied in various polymeric layers, but it is ordinarily desirable to utilize rubbery synthetic latex compositions which will also serve to provide a cushioning effect beneath the carpet backing. The polymer layer is preferably applied directly to the carpet backing into contact with the fibers which are woven into the backing, although it is also possible to apply the polymer layer over an intermediate layer or film through which the active antistatic agent and carrier are also capable of migrating into contact with the fibers and thence throughout the fibers themselves.

While other carrier materials may be identified by those skilled in the art, it has been found that the following materials are suitable carriers or accelerators for antistatic active agents when used in accordance with this invention: phenol, o-chlorophenol and Dowanol EPh, an ethylene glycol phenyl ether composition of Dow Chemical Co.

As the antistatic agent, those skilled in the art will also be able to identify other suitable materials, but we have found that the following agents are effective:

a. steroamino propyl dimethyl-β-hydroxyethyl ammonium nitrate-available commercially under the trade name Aerotex Antistatic CSN Concentrate.

b. methylbis(2-hydroxyethyl) cocoammonium chloride — available commercially under the trade name Ethoquad C/12.

c. free acids of complex organic phosphate esters - available commercially under the trade names Gafstat AS-610 and AS-710.

d. Advastat 50, a proprietary formulation.

It has also been noted that the addition of a small amount of surfactant improves the results of the invention.

The antistatic agent should be present in the layer in an amount of at least 4 ounces per square yard of carpet in order to reduce the static charge build up level below 3,000 volts.

As the polymeric material for use in the coating composition containing the antistatic agent, and in some cases also the carrier or accelerator a number of polymers will function acceptably and those skilled in the art will no doubt be able to identify others in addition to the ones specifically described herein. However, we have found the following to be satisfactory:

a. carboxylated styrene-butadiene rubber latexes — available commercially under the trade names Lotol L-9960 and Vulcanol 5023.

b. synthetic rubber/resin lacquer base in a volatile solvent (adhesive) — available commercially under the trade name CVV.

c. polyvinyl chloride plastisol — available commercially under the trade name AD-254, and d. polyvinyl chloride resin plasticized with dioctyl phthalate.

DETAILED DESCRIPTION OF THE INVENTION

More specific aspects of the present invention will be appreciated in view of the following specific examples.

EXAMPLE 1

A level loop nylon carpet made from duPont nylon fibers was obtained in a semi-finished form, that is, the fibers were locked in a primary backing but no additional latex or other backing materials had been applied to the underside of the carpet.

A rubber latex available under the trade name Vulcanol 5023 was obtained. To 65 parts of the rubber latex there was added 15 parts of Advastat 50, 15 parts of Dowanol EPh and 5 parts of a surfactant, Aerosol O.T. 75. The underside of a 28 inch × 30 inch sample of the nylon carpet weighing 491.2 grams was coated with 594.5 grams of the foregoing composition. The sample was dried in an oven at 275° F for 25 minutes. The total dried weight of the carpet plus the backing layer was 840.5 grams. The weight of the antistatic agent was 10.6% of the total weight of the finished product.

The volume resistivity of the treated carpet was measured at $2.4 \times 10^9$ as compared with $2.8 \times 10^{11}$ for the untreated carpet.

The carpet was then subjected to a "stroll test" (AATCC Test Method 134-1969) to determine the static level in volts for the untreated and treated samples. The threshold volume of 3,000 volts was used as the guideline to determine whether the carpet sample was antistatic, since, as described above, 3,000 volts is the point at which humans are sensitive to shock from the discharge of accumulated static electricity. The untreated sample showed a voltage of 13,200 whereas the voltage on the treated sample was 1600 volts, far below the threshold level. The treated carpet was shampooed under commercial conditions and retested. After drying to 20% relative humidity, the volume resistivity was found to be 100 volts.

The treated carpet was then placed in a hallway and subjected to normal use. The number of persons walking across the carpet was counted. After 16,000 cycles (1 cycle equals one person walking across the carpet) the carpet was re-tested and showed a static level of 5,200 volts, above the threshold level. Upon shampooing the carpet and re-testing it was found that the static level had returned to 1,200 volts, well within acceptable limits. Exposure to 16,000 cycles is roughly equivalent to two years of normal residential use.

The exact explanation for this result is not fully understood. Apparently the buildup of soil during normal usage impairs the effectiveness of the antistatic material in the fibers. Upon removal of the soil by shampooing and perhaps the removal of some of the antistatic agent in the same process, the antistatic characteristics are fully restored. The ability of the carpet to recover its high antistatic level is believed to be attributable to continued migration of material from the layer applied to the backing up through the fibers and to the accelerated migration attributable to the use of a carrier in the composition.

EXAMPLES 2 – 56

The process as generally described in Example 1 was repeated except for the changes indicated in Table 1. In those instances in which a carrier is employed, the presence of the carrier in the composition resulted in improvement in the antistatic properties of the carpet.

TABLE 1

| Ex. No. | Carpet Fiber | Antistat | Coating Base | Carrier |
|---|---|---|---|---|
| 2 | Nylon(Bigelow) | Ethoquad C/12 | Letol L-9960 | none |
| 3 | " | Ethoquad C/12 | Letol L-9960 | none |
| 4 | " | none | Letol L-9960 | none |
| 5 | Nylon(Bigelow) | Advastat 50 | PVC Resin & DOP | none |
| 6 | " | Ethoquad C/12 | PVC Resin & DOP | none |
| 7 | " | Aerotex Antistatic CSN | PVC Resin & DOP | none |
| 8 | " | none | PVC Resin & DOP | none |
| 9 | Nylon(Bigelow) | Ethoquad C/12 | PVC Resin & DOP | none |
| 10 | " | Ethoquad C/12 | PVC Resin & DOP | none |
| 11 | " | Ethoquad C/12 | AD 254 | none |

TABLE 1-continued

| Ex. No. | Carpet Fiber | Antistat | Coating Base | Carrier |
|---|---|---|---|---|
| 12 | " | none | AD 254 | none |
| 13 | Nylon(Bigelow) | Advastat 50 | AD 254 | Phenol |
| 14 | " | none | AD 254 | none |
| 15 | Polyester(duPont) | Advastat 50 | AD 254 | o-chlorphenol |
| 16 | " | none | AD 254 | none |
| 17 | Nylon(Bigelow) | Advastat 50 | Vulcanol 5023 | Phenol |
| 18 | " | Advastat 50 | Vulcanol 5023 | Phenol |
| 19 | " | none | Vulcanol 5023 | none |
| 20 | Polyester(duPont) | Advastat 50 | Vulcanol 5023 | Dowanol EPh |
| 21 | " | Advastat 50 | Vulcanol 5023 | Dowanol EPh |
| 22 | " | none | Vulcanol 5023 | none |
| 23 | Nylon hi-lo(duPont) | Ethoquad C/12 | Vulcanol 5023 | Phenol |
| 24 | " | Ethoquad C/12 | Vulcanol 5023 | none |
| 25 | " | none | Vulcanol 5023 | none |
| 26 | " | Advastat 50 | Vulcanol 5023 | Phenol |
| 27 | " | Advastat 50 | Vulcanol 5023 | none |
| 28 | " | none | Vulcanol 5023 | none |
| 29 | Nylon(Bigelow) | Advastat 50 | Vulcanol 5023 | Phenol |
| 30 | " | Advastat 50 | Vulcanol 5023 | none |
| 31 | " | none | Vulcanol 5023 | none |
| 32 | POlyester(duPont) | Advastat 50 | Vulcanol 5023 | Dowanol EPh |
| 33 | " | Advastat 50 | Vulcanol 5023 | none |
| 34 | " | none | Vulcanol 5023 | none |
| 35 | Nylon(Brookline) | Advastat 50 | Vulcanol 5023 | Dowanol EPh |
| 36 | " | Advastat 50 | Vulcanol 5023 | Dowanol EPh |
| 37 | " | Advastat 50 | Vulcanol 5023 | none |
| 38 | " | none | Vulcanol 5023 | none |
| 39 | Nylon hi-lo(duPont) | Advastat 50 | Vulcanol 5023 | Dowanol EPh |
| 40 | " | Advastat 50 | Vulcanol 5023 | Dowanol EPh |
| 41 | " | none | Vulcanol 5023 | none |
| 42 | Nylon(Lees) | Advastat 50 | Vulcanol 5023 | Dowanol EPh |
| 43 | Nylon(Lees) | none | Vulcanol 5023 | none |
| 44 | Nylon(Bigelow) | Advastat 50 | Vulcanol 5023 | Dowanol EPh |
| 45 | " | none | Vulcanol 5023 | none |
| 46 | Nylon-level loop (duPont) | Advastat 50 | Vulcanol 5023 | Dowanol EPh |
| 47 | " | Advastat 50 | Vulcanol 5023 | none |
| 48 | " | none | Vulcanol 5023 | none |
| 49 | Polyester(duPont) | Advastat 50 | Vulcanol 5023 | Dowanol EPh |
| 50 | " | none | Vulcanol 5023 | none |
| 51 | Nylon-level loop (duPont) | Advastat 50 | Vulcanol 5023 | Dowanol EPh |
| 52 | Nylon hi-lo (duPont) | Advastat 50 | Vulcanol 5023 | Dowanol EPh |
| 53 | Nylon(Brookline) | Advastat 50 | Vulcanol 5023 | Dowanol EPh |
| 54 | Nylon(Lees) | Advastat 50 | Vulcanol 5023 | Dowanol EPh |
| 55 | Nylon(Bigelow) | Advastat 50 | Fulcanol 5023 | Dowanol EPh |
| 56 | Polyester(duPont) | Advastat 50 | Vulcanol 5023 | Dowanol EPh |

| | Surfactant | % Wt. AA | Surface Resistivity ohms per square | Volume Resistivity ohms |
|---|---|---|---|---|
| 2 | none | 19.7 | $1.3 \times 10^{11}$ | $6.2 \times 10^{9}$ |
| 3 | Triton X-200 | 21.5 | $1.1 \times 10^{11}$ | $4.0 \times 10^{9}$ |
| 4 | none | untreated | $2.2 \times 10^{11}$ | $4.2 \times 10^{9}$ |
| 5 | none | 5.4 | not tested | $2.1 \times 10^{9}$ |
| 6 | none | 5.3 | " | $3.5 \times 10^{9}$ |
| 7 | none | 5.9 | " | $3.2 \times 10^{9}$ |
| 8 | none | untreated | " | $1.2 \times 10^{10}$ |
| 9 | Aerosol O.T. 75 | 9.8 | $6.9 \times 10^{9}$ | $1.5 \times 10^{7}$ |
| 10 | none | 9.6 | $1.5 \times 10^{10}$ | $1.2 \times 10^{9}$ |
| 11 | none | 9.9 | $3.6 \times 10^{9}$ | $2.4 \times 10^{8}$ |
| 12 | none | untreated | $1.0 \times 10^{11}$ | $3.2 \times 10^{9}$ |
| 13 | none | 4.3 | $2.6 \times 10^{9}$ | not tested |
| 14 | none | untreated | $4.0 \times 10^{10}$ | " |
| 15 | none | 3.6 | $6.0 \times 10^{10}$ | not tested |
| 16 | none | untreated | $1.5 \times 10^{11}$ | " |
| 17 | none | 13.5 | $5.6 \times 10^{9}$ | $5.6 \times 10^{8}$ |
| 18 | none | 19.7 | $3.8 \times 10^{9}$ | $2.8 \times 10^{8}$ |
| 19 | none | untreated | $1.2 \times 10^{11}$ | $1.3 \times 10^{11}$ |
| 20 | none | 13.5 | $6.4 \times 10^{10}$ | $1.6 \times 10^{9}$ |
| 21 | none | 19.1 | $1.8 \times 10^{10}$ | $9.7 \times 10^{7}$ |
| 22 | none | untreated | $2.7 \times 10^{11}$ | $1.2 \times 10^{12}$ |
| 23 | none | 14.9 | $2.0 \times 10^{11}$ | $4.1 \times 10^{10}$ |
| 24 | none | 15.2 | $1.7 \times 10^{11}$ | $1.0 \times 10^{11}$ |
| 25 | none | untreated | $3.9 \times 10^{11}$ | $2.7 \times 10^{11}$ |
| 26 | none | 19.2 | $7.8 \times 10^{10}$ | $3.2 \times 10^{10}$ |
| 27 | none | 16.8 | $1.1 \times 10^{11}$ | $5.0 \times 10^{10}$ |
| 28 | none | untreated | $9.4 \times 10^{10}$ | $1.1 \times 10^{11}$ |
| 29 | none | 14.7 | $6.7 \times 10^{10}$ | $7.0 \times 10^{8}$ |
| 30 | none | 14.8 | $1.4 \times 10^{10}$ | $2.2 \times 10^{9}$ |
| 31 | none | Untreated | $9.4 \times 10^{10}$ | $1.1 \times 10^{11}$ |
| 32 | none | 17.6 | $6.7 \times 10^{10}$ | $7.0 \times 10^{8}$ |
| 33 | none | 16.9 | $1.0 \times 10^{11}$ | $8.0 \times 10^{10}$ |
| 34 | none | Untreated | $1.1 \times 10^{11}$ | $1.1 \times 10^{11}$ |
| 35 | Aerosol O.T. 75 | 12.3 | $2.6 \times 10^{8}$ | $8.6 \times 10^{5}$ |
| 36 | none | 12.6 | $2.7 \times 10^{9}$ | $5.5 \times 10^{8}$ |
| 37 | none | 12.5 | $1.1 \times 10^{10}$ | $5.0 \times 10^{6}$ |
| 38 | none | Untreated | $7.9 \times 10^{10}$ | $1.6 \times 10^{11}$ |
| 39 | Aerosol O.T. 75 | 12.3 | $8.6 \times 10^{9}$ | $5.2 \times 10^{8}$ |

TABLE 1-continued

| Ex. No. | Carpet Fiber | Antistat | Coating Base | Carrier |
|---|---|---|---|---|
| 40 | none | 12.7 | $8.9 \times 10^{10}$ | $2.7 \times 10^{10}$ |
| 41 | none | Untreated | $1.2 \times 10^{11}$ | $1.5 \times 10^{11}$ |
| 42 | Aerosol O.T. 75 | 12.9 | $5.4 \times 10^{10}$ | $1.2 \times 10^{10}$ |
| 43 | none | Untreated | $1.2 \times 10^{11}$ | $1.5 \times 10^{11}$ |
| 44 | Aerosol O.T. 75 | 12.2 | $5.7 \times 10^{8}$ | $7.7 \times 10^{7}$ |
| 45 | none | Untreated | $1.2 \times 10^{11}$ | $1.5 \times 10^{11}$ |
| 46 | none | 16.1 | $2.9 \times 10^{11}$ | $1.5 \times 10^{10}$ |
| 47 | none | 16.7 | $2.6 \times 10^{11}$ | $1.2 \times 10^{11}$ |
| 48 | none | Untreated | $2.6 \times 10^{11}$ | $2.8 \times 10^{11}$ |
| 49 | none | 15.6 | $1.8 \times 10^{11}$ | $2.4 \times 10^{9}$ |
| 50 | none | Untreated | $2.2 \times 10^{11}$ | $2.2 \times 10^{11}$ |
| 51 | Aerosol O.T. 75 | 10.6 | not tested | $2.4 \times 10^{9}$ |
| 52 | Aerosol O.T. 75 | 11.0 | " | $7.6 \times 10^{8}$ |
| 53 | Aerosol O.T. 75 | 10.1 | " | $0.3 \times 10^{2}$ |
| 54 | Aerosol O.T. 75 | 10.7 | " | $5.8 \times 10^{9}$ |
| 55 | Aerosol O.T. 75 | 10.3 | " | $5.0 \times 10^{8}$ |
| 56 | Aerosol O.T. 75 | 12.0 | " | $3.4 \times 10^{9}$ |

EXAMPLE 57

An acrylic carpet swatch was obtained from Bigelow-Sanford. This swatch comprises acrylic fiber tufted in a primary backing, rubber latex to lock the fiber, and a secondary backing (jute).

An antistatic backing adhesive was prepared by adding 30 parts Advastat 50 to 250 parts CVV. The secondary backing was removed from the carpet swatch. 6.7 grams of antistatic backing adhesive was applied on the rubber latex layer of a 2 inch × 3 inch carpet sample (7.1g) and dried in the oven at 125°F for 1 hour. The total weight of the carpet and the antistatic backing adhesive was 9.5 g and the % weight of Advastat 50 was 7.6% based on the total weight of the finished carpet.

After two weeks of aging at the testing conditions, the treated carpet showed a volume resistivity of $2.2 \times 10^{9}$ ohms at 76°F/50%RH. The untreated carpet showed a volume resistivity of $6.0 \times 10^{9}$ ohms.

EXAMPLES 58–62

The same procedure was followed as set forth in Example 57 but using different amounts of antistatic agent and different carpet materials. The results are shown in Table 2.

Table 2

| Ex. No. | Carpet Fiber | Antistat | % Wt. AA | Volume Resistivity,ohms |
|---|---|---|---|---|
| 57 | Acrylic | Advastat 50 | 7.6 | $2.2 \times 10^{9}$ |
| | " | none | | $6.0 \times 10^{9}$ |
| 58 | Acrylic | Advastat 50 | 5.1 | $1.3 \times 10^{8}$ |
| | " | none | | $2.4 \times 10^{9}$ |
| 59 | Acrylic | Advastat 50 | 5.3 | $2.4 \times 10^{9}$ |
| | " | none | | $6.2 \times 10^{9}$ |
| 60 | Olefin | Advastat 50 | 4.1 | $1.0 \times 10^{9}$ |
| | " | none | | $6.0 \times 10^{10}$ |
| 61 | Wool | Advastat 50 | 3.6 | $6.0 \times 10^{9}$ |
| | " | none | | $8.0 \times 10^{10}$ |
| 62 | Polyester | Advastat 50 | 4.7 | $5.0 \times 10^{11}$ |
| | " | none | | $4.0 \times 10^{11}$ |

EXAMPLES 63–79

Additional carpet (swatches) samples were also obtained from Bigelow. The rubber latex and the secondary jute backing were removed prior to applying the antistatic backing adhesive which was prepared by adding an antistat to CVV. In this case, the antistatic backing adhesive was air-dried instead of being oven dried and the carpets were tested after 3 weeks of aging.

The results are reported in Table 3.

Table 3

| Ex. No. | Carpet Fiber | Antistat in CVV | % Wt. AA | Volume Resistivity ohms |
|---|---|---|---|---|
| 63 | Acrylic | Advastat 50 | 15.8 | $1.7 \times 10^{9}$ |
| 64 | " | Gafstat AS-610 | 12.9 | $3.0 \times 10^{10}$ |
| 65 | " | Gafstat AS-710 | 12.3 | $7.4 \times 10^{8}$ |
| 66 | " | None | | $3.0 \times 10^{9}$ |
| 67 | Nylon | Advastat 50 | 19.8 | $1.6 \times 10^{11}$ |
| 68 | " | Gafstat AS-610 | 15.1 | $1.7 \times 10^{11}$ |
| 69 | " | Gafstat AS-710 | 17.8 | $1.1 \times 10^{11}$ |
| 70 | " | None | | $1.6 \times 10^{11}$ |
| 71 | Polyester | Gafstat AS-610 | 11.6 | $1.0 \times 10^{11}$ |
| 72 | " | Gafstat AS-710 | 10.9 | $1.1 \times 10^{11}$ |
| 73 | " | None | | $2.6 \times 10^{11}$ |
| 74 | Olefin | Gafstat AS-610 | 16.4 | $1.8 \times 10^{10}$ |
| 75 | " | Gafstat AS-710 | 16.0 | $1.8 \times 10^{10}$ |
| 76 | " | None | | $1.6 \times 10^{10}$ |
| 77 | Wool | Gafstat AS-610 | 12.2 | $1.0 \times 10^{10}$ |
| 78 | " | Gafstat AS-710 | 14.3 | $1.1 \times 10^{10}$ |

Table 3-continued

| Ex. No. | Carpet Fiber | Antistat in CVV | % Wt. AA | Volume Resistivity ohms |
|---|---|---|---|---|
| 79 | " | None | | $1.3 \times 10^{10}$ |

In the course of our experimentation, it was determined that the antistatic agent in the layer applied to the carpet backing should be present in an amount of at least about 4 ounces per square yard of the carpet fabric. The following tests indicated that contents of antistatic agents below about 4 ounces per square yard gave static level voltages well above the threshold level of 3,000 volts:

| Carpet Type | Company testing | Amount of anti-static agent (oz/yd²) | Static level involved |
|---|---|---|---|
| Tufted nylon | Bigelow-Sanford | .53 | 15,500 |
| Tufted nylon | Bigelow-Sanford | 1.6 | 11,500 |
| Tufted nylon | Bigelow-Sanford | 2.5 | 10,500 |
| Level loop nylon | Dupont | 4.8 | 1,600 |
| Lees nylon pattern 4996 | Lees | 5 | 1,100 |
| Hi/Lo nylon | Dupont | 6.5 | 200 |

The results of stroll tests on a representative section of carpet types is set forth in Table 4.

Table 4

| Carpet | As Tested in Laboratory Vol. Resistivity, ohms | | Initial "Stroll Test" Static Level, Volts | | Treated After Cleaning | After 16.000 Cycles Before Shampoo | After 16.000 Cycles After Shampoo |
|---|---|---|---|---|---|---|---|
| | Untreated | Treated | Untreated | Treated | | | |
| Hi-Lo Nylon (duPont) | $2.2 \times 10^{11}$ | $7.6 \times 10^{9}$ | 13,200 | 200 | 100 | 3,800 | 300 |
| Level Loop Nylon (duPont) | $2.8 \times 10^{11}$ | $2.4 \times 10^{9}$ | 13,200 | 1,600 | 100 | 5,200 | 1,200 |
| Polyester (duPont) | $2.2 \times 10^{11}$ | $2.0 \times 10^{9}$ | 9,200 | 300 | 100 | 1,200 | 100 |
| Nylon (Lees) | $1.3 \times 10^{11}$ | $5.8 \times 10^{9}$ | N.T.* | 1,100 | N.T. | N.T. | N.T. |
| Nylon (Bigelow) | $1.0 \times 10^{11}$ | $5.0 \times 10^{8}$ | N.T. | N.T. | N.T. | N.T. | N.T. |
| Nylon (Brookline) | $3.6 \times 10^{10}$ | 29 | N.T. | N.T. | N.T. | N.T. | N.T. |

*N.T. = Not Tested

If an intermediate layer or layers is incorporated in the structure between the backing and the polymeric layer containing the antistatic agent, any polymeric material capable of forming a solid layer may be used provided that it allows migration of the antistatic agent and carrier through the layers and into the fibers. It is preferable to employ a rubber latex or foamed polyvinyl chloride as the polymer layer containing the antistatic agent in order to gain the benefit of the cushioning effect of such a layer.

It will be understood that those skilled in the art may well devise combinations of materials and techniques other than those expressly described above without departing from the spirit of this invention, or the scope of the following claims.

What is claimed is:

1. A carpet exhibiting antistatic properties comprising a primary carpet backing, carpet fibers, the bases of which are locked in said primary backing, said fibers being selected from the group consisting of wool, acrylic, nylon, polyester, and lower polyolefin fibers, and a coating of polymeric composition on the surface of said primary backing opposite the carpet pile, but in contact with the bases of said fibers, said coating containing an antistatic agent which is present in an amount of at least about four ounces per square yard of carpet surface area, and is capable of migrating into and throughout the length of said carpet fibers to render the fibers themselves antistatic to the extent that static buildup is maintained below 3,000 volts.

2. The carpet of claim 1 further comprising a carrier in said coating which accelerates the migration of said antistatic agent into and throughout said carpet fibers.

3. The carpet of claim 2 wherein said carpet fibers are of a material selected from the group consisting of nylon and polyester and mixtures thereof.

4. The carpet of claim 3 wherein said carrier is selected from the group consisting of phenol, o-chlorophenol, and ethylene glycol phenyl ether.

5. The carpet of claim 2 wherein said carrier is selected from the group consisting of phenol, o-chlorophenol, and ethylene glycol phenyl ether.

6. The carpet of claim 1 wherein said polymeric composition comprises as the principal component a synthetic rubber latex.

7. The carpet of claim 6 wherein said coating composition further comprises a minor amount of surfactant.

8. The carpet of claim 1 wherein said coating composition further comprises a minor amount of a surfactant.

9. The carpet of claim 1 wherein said antistatic agent is selected from the group consisting of steroamino propyl dimethyl-$\beta$-hydroxyethyl ammonium nitrate, methylbis(2-hydroxyethyl) cocoammonium chloride, free acid complexes of organic phosphate esters, and mixtures thereof.

10. The carpet of claim 1 wherein said polymeric composition comprises as the principal component a material selected from the group consisting of carboxylated styrene-butadiene rubber latex, adhesive synthetic rubber/lacquer base, and polyvinylchloride plastisols, and plasticized polyvinylchloride resin.

* * * * *